US008584440B2

(12) United States Patent
Oh et al.

(10) Patent No.: US 8,584,440 B2
(45) Date of Patent: Nov. 19, 2013

(54) CELLULOSE-BASED FIBER, AND TIRE CORD COMPRISING THE SAME

(75) Inventors: Young-Se Oh, Busan (KR); So-Yeon Kwon, Busan (KR); Jong-Cheol Jeong, Seoul (KR); Woo-Chul Kim, Chilgok-gun (KR); Ok-Hwa Jeon, Gyeongsan-shi (KR); Il Chung, Goomi-shi (KR); Jae-Woong Lee, Daegu (KR); Gi-Woong Kim, Daegu (KR)

(73) Assignee: Kolon Industries, Inc., Kwacheon (KR)

( * ) Notice: Subject to any disclaimer, the term of this patent is extended or adjusted under 35 U.S.C. 154(b) by 209 days.

(21) Appl. No.: 12/674,880

(22) PCT Filed: Sep. 8, 2008

(86) PCT No.: PCT/KR2008/005290

§ 371 (c)(1),
(2), (4) Date: Feb. 23, 2010

(87) PCT Pub. No.: WO2009/031869

PCT Pub. Date: Mar. 12, 2009

(65) Prior Publication Data

US 2011/0118389 A1 May 19, 2011

(30) Foreign Application Priority Data

Sep. 7, 2007 (KR) ..... 10-2007-0091169
Sep. 7, 2007 (KR) ..... 10-2007-0091170
Sep. 7, 2007 (KR) ..... 10-2007-0091171
Sep. 7, 2007 (KR) ..... 10-2007-0091172
Jun. 27, 2008 (KR) ..... 10-2008-0061530

(51) Int. Cl.

| | |
|---|---|
| ***D02G 3/36*** | (2006.01) |
| ***D01G 13/00*** | (2006.01) |
| ***C08F 283/04*** | (2006.01) |
| ***C08G 69/48*** | (2006.01) |
| ***C08L 77/00*** | (2006.01) |

(52) U.S. Cl.
USPC ..... 57/244; 525/420; 19/145

(58) Field of Classification Search
USPC ..... 525/329.4, 329.7, 420, 333.3, 56; 19/145; 57/244
See application file for complete search history.

(56) References Cited

U.S. PATENT DOCUMENTS

| | | | | |
|---|---|---|---|---|
| 2,775,505 | A | 12/1956 | Pedlow | |
| 3,508,941 | A * | 4/1970 | Johnson | 106/141.1 |
| 4,357,389 | A * | 11/1982 | Satoh et al. | 428/373 |
| 4,418,026 | A * | 11/1983 | Blackie et al. | 264/8 |
| 4,464,323 | A | 8/1984 | O'Brien | |
| 4,725,394 | A * | 2/1988 | O'Brien | 264/187 |
| 5,094,913 | A * | 3/1992 | Yang | 428/364 |
| 5,366,781 | A * | 11/1994 | Coburn et al. | 428/113 |
| 5,609,957 | A * | 3/1997 | Page et al. | 428/372 |
| 5,753,367 | A * | 5/1998 | Takemura et al. | 428/372 |
| 5,776,609 | A * | 7/1998 | McCullough | 428/375 |
| 6,048,479 | A | 4/2000 | Hashemzadeh | |
| 6,245,837 | B1 | 6/2001 | Cassel et al. | |
| 6,248,444 | B1 | 6/2001 | Kido et al. | |
| 6,500,215 | B1 * | 12/2002 | Login et al. | 8/481 |
| 6,555,678 | B1 * | 4/2003 | Allandrieu et al. | 536/57 |
| 6,706,876 | B2 * | 3/2004 | Luo et al. | 536/56 |
| 6,821,599 | B1 * | 11/2004 | Kuroda et al. | 428/97 |
| 7,057,023 | B2 * | 6/2006 | Islam et al. | 530/412 |
| 2002/0148050 | A1 * | 10/2002 | Luo et al. | 8/115.51 |
| 2003/0148689 | A1 * | 8/2003 | Lapierre | 442/327 |
| 2004/0126577 | A1 | 7/2004 | Lee et al. | |
| 2004/0212892 | A1 * | 10/2004 | Tsujimoto | 359/599 |
| 2005/0079348 | A1 | 4/2005 | Lee et al. | |
| 2006/0134337 | A1 * | 6/2006 | Glassel et al. | 427/387 |
| 2007/0287008 | A1 * | 12/2007 | Hartmann et al. | 428/393 |
| 2008/0233821 | A1 * | 9/2008 | Ruf et al. | 442/181 |
| 2008/0299160 | A1 * | 12/2008 | Agboh et al. | 424/405 |
| 2009/0321025 | A1 * | 12/2009 | Weightman et al. | 162/50 |

FOREIGN PATENT DOCUMENTS

| | | | |
|---|---|---|---|
| CN | 1228819 | A | 9/1999 |
| KR | 2002-0085188 | A | 11/2002 |
| KR | 10-0398140 | B1 | 9/2003 |
| KR | 10-0486812 | B1 | 4/2005 |

OTHER PUBLICATIONS

Lee et al. Journal of Engineered Fibers and Fabrics, 2(4), 2007, 25-32).*

European Search Report issued in corresponding EP Application No. 08829157.0, dated Nov. 4, 2010.

Korean Patent Office, Korean Office Action issued in corresponding KR Application No. 10-2008-0061530, dated Jan. 21, 2013.

* cited by examiner

*Primary Examiner* — Liam Heincer

(74) *Attorney, Agent, or Firm* — Sughrue Mion, PLLC

(57) ABSTRACT

The present invention provides cellulose-based fibers including cellulose and at least one polymer selected from the group consisting of a polysiloxane, a polyacrylic acid, a polyacrylamide, an m-aramid, and a polyvinylalcohol/polystyrene copolymer, and a tire cord including the same. Furthermore, the cellulose-based fibers of the present invention have an advantage in superior elongation and tenacity of the prior cellulose fibers by blending at least one polymer having a functional group that is capable of a hydrogen bond with a hydroxyl group of a cellulose molecule.

12 Claims, No Drawings

CELLULOSE-BASED FIBER, AND TIRE CORD COMPRISING THE SAME

CROSS REFERENCE TO RELATED APPLICATION

This application is a National Stage of International Application No. PCT/KR2008/005290 filed Sep. 8, 2008, claiming priority based on Korean Patent Application Nos. 10-2007-0091169, 10-2007-0091170, 10-2007-0091171, and 10-2007-0091172, filed Sep. 7, 2007 respectively, and 10-2008-0061530, filed Jun. 27, 2008, the contents of all of which are incorporated herein by reference in their entirety.

BACKGROUND OF THE INVENTION (a) Field of the Invention

The present invention relates to cellulose-based fibers and a tire cord including the same.

(b) Description of the Related Art

Nylon, polyester, rayon, and the like are generally used as materials for a tire cord. The rating and use of the tire are limited according to the merits and demerits of the materials.

Nylon fiber is mainly used in tires for heavy-duty trucks that are subjected to heavy loads, or in tires mainly used on irregular surfaces such as unpaved roads, because it has high tensile properties. However, the nylon fiber is unsuitable for a passenger car requiring high speed driving and riding comfort, because it generates intensive heat accumulation inside of the tire, and has a low modulus.

Polyester fiber has good shape stability and a competitive price in comparison with the nylon, its tenacity and adhesive tenacity are being improved by continuous studies, and the amount used in the field of tire cords is tending to increase. However, it is unsuitable for a tire for high speed driving, because there are still limitations in heat resistance, adhesive tenacity, and so on.

Rayon fiber, a regenerated cellulose fiber, shows a superior tensile properties and shape stability at high temperatures. Therefore, the rayon fiber is known as the most suitable material for a tire cord. However, it requires substantial moisture control when preparing the tire, because the strength is severely deteriorated by moisture and the rate of inferior goods is high due to the heterogeneity during preparation of the fiber. First of all, its performance by price (strength by price) is very low in comparison with the other materials, and thus it is only applied to an ultra high speed driving tire or a high-priced tire.

Korea patent publication No. 2002-0085188 discloses a tire cord prepared by using lyocell fibers having superior dry tenacity, wet tenacity, and modulus to rayon fiber. However, there is a disadvantage in that the tensile properties of the lyocell fibers decreases according to repeated fatigue because of higher modulus and lower breaking elongation than the rayon fibers, and the life span of a tire using it decreases.

As disclosed above, the cellulose-based fibers such as rayon and the like have a stiff molecular structure, but there is a problem in that the strength severely deteriorates in processes of twisting and heat-treating because of their low elongation. Therefore, it is needed to develop a tire cord that decreases less in strength even under repeated fatigue while maintaining established tenacity and that can be used for preparing a long lasting tire, and cellulose-based fibers that can be used for the tire cord.

SUMMARY OF THE INVENTION

An aspect of the present invention is to provide cellulose-based fibers having superior mechanical tenacity and elongation.

Another aspect of the present invention is to provide a tire cord that includes the cellulose-based fibers and is superior in shape stability and tensile properties, and that is suitable for a high speed driving tire.

The present invention particularly provides cellulose-based fibers including cellulose and at least one polymer selected from the group consisting of a polysiloxane, a polyacrylic acid, a polyacrylamide, an m-aramid, and a polyvinylalcohol/polystyrene copolymer.

The present invention also provides a method of preparing the cellulose-based fibers including the steps of preparing a spinning dope including cellulose and at least one polymer selected from the group consisting of a polysiloxane, a polyacrylic acid, a polyacrylamide, an m-aramid, and a polyvinylalcohol/polystyrene copolymer, preparing multi-filaments by spinning the dope, solidifying the filaments, washing the solidified filaments, and drying the washed filaments.

In addition, the present invention provides a tire cord including the cellulose-based fibers.

DETAILED DESCRIPTION OF THE EMBODIMENTS

Hereinafter, the present invention is explained in more detail.

In the present invention, the filament bundle including a plurality of filament fibers is called "multi-filaments", the raw cord prepared by Z twisting (counter-clockwise twisting) and S twisting (clockwise twisting) (or S twisting and Z twisting) the multi-filaments is called "twisted yarn", and the dipped cord prepared by treating the twisted yarn with an adhesive for a tire cord is called "tire cord".

Furthermore, in the present invention, "tenacity" means a breaking tenacity of the fibers and "elongation" means a breaking elongation according to the Korean Industrial Standard (KSK).

The cellulose-based composite fibers according to the present invention include cellulose and at least one polymer selected from the group consisting of a polysiloxane, a polyacrylic acid, a polyacrylamide, an m-aramid, and a polyvinylalcohol/polystyrene copolymer.

The cellulose that is common in the art to which the present invention pertains may be used, however a cellulose in which the content of α-cellulose is 96% or more may be used in order to improve the properties of the fibers, and particularly a southern pine pulp in which the content of α-cellulose is 96% or more may be used.

Furthermore, the polymer having a functional group that is capable of reacting with a hydroxyl group of the cellulose molecule may be used, and the polymer includes a repeating unit represented by any one of the following Chemical Formulae 1 to 5:

[Chemical Formula 1]

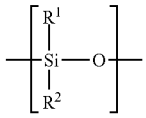

[Chemical Formula 2]

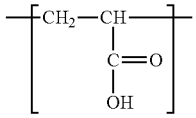

-continued

[Chemical Formula 3]

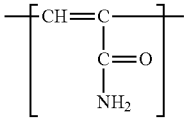

[Chemical Formula 4]

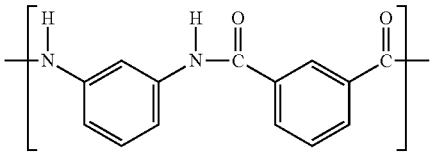

[Chemical Formula 5]

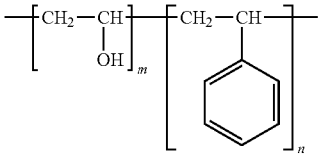

wherein at least one of $R^1$ and $R^2$ is a hydrophilic group selected from the group consisting of an amine, a hydroxyl, a carboxyl, an amide, and an imide; a $C_1$-$C_5$ alkyl that is substituted by the hydrophilic group; or a $C_6$-$C_{20}$ aryl, arylalkyl, alkylaryl, heteroaryl, heteroarylalkyl, or heteroalkylaryl that is substituted by the hydrophilic group;

the remaining $R^1$ and $R^2$ is a $C_1$-$C_5$ alkyl, or a $C_6$-$C_{20}$ aryl, arylalkyl, alkylaryl, heteroaryl, heteroarylalkyl, or heteroalkylaryl; and the mole ratio of m:n is 5:5 to 9:1.

More concretely, the polymer may be a polysiloxane including the repeating unit represented by Chemical Formula 1, a polyacrylic acid including the repeating unit represented by Chemical Formula 2, a polyacrylamide including the repeating unit represented by Chemical Formula 3, an m-aramid including the repeating unit represented by Chemical Formula 4, and a polyvinylalcohol/polystyrene copolymer including the repeating unit represented by Chemical Formula 5.

In the cellulose-based fibers according to the present invention, it is preferable that the content of the polymer is 0.1 to 20 wt % of the totality. The elongation can be improved when the content of the polymer is 0.1 wt % or more, and miscibility with the cellulose can be obtained and the intrinsic tenacity property of the cellulose can be revealed when the content is 20 wt % or less.

Particularly, when the m-aramid is used as the polymer, it is preferable that the content is 0.1 to 30 wt % of the totality, because various properties such as good elongation, tenacity, modulus, and the like can be granted to a tire cord. The m-aramid may preferably take a role of improving the elongation and the like of the cellulose-based composite fibers of the present invention when the content of the m-aramid is 0.1 wt % or more, and the miscibility with the cellulose-based polymer is good and the composite fibers may have the intrinsic tenacity property of the cellulose-based polymer when the content is 30 wt % or less.

Furthermore, the weight average molecular weight of the polysiloxane used in the present invention may be 500 to 4,000,000, and preferably 500 to 2,000,000, and more preferably 1000 to 1,000,000. The viscosity average molecular weight of the polyacrylic acid and the polyvinylalcohol/polystyrene copolymer may be 10,000 to 4,000,000, and preferably 10,000 to 2,000,000, and more preferably 20,000 to 1,000,000. The weight average molecular weight of the polyacrylamide may be 10,000 to 8,000,000.

It is more preferable that the weight average molecular weight or the viscosity average molecular weight of each polymer is in an optimal range, because the effect of improving the elongation and the effects of revealing good tenacity and maintaining the shape stability can be obtained in the range at the same time.

Furthermore, the m-aramid having an intrinsic viscosity (I.V) of 0.8 to 2.0 may be used. The m-aramid having an intrinsic viscosity (I.V) of 0.8 or more is preferable in the sides of improving the elongation and maintaining the strength of the composite fibers, and the m-aramid having an intrinsic viscosity (I.V) of 2.0 or less is preferable in the sides of preventing the thermal degradation due to excessively high spinning temperature and improving the elongation of the composite fibers.

It is preferable that the mole ratio of the repeating unit of the polyvinylalcohol to the repeating unit of the polystyrene is 5:5 to 9:1 in the polyvinylalcohol/polystyrene copolymer. The affinity to the cellulose is good when the mole ratio of the repeating unit of the polyvinylalcohol is 50% or more, and the solubility to water is suitable and the collecting process of N-methylmorpholine-N-oxide (NMMO) becomes easy when the mole ratio of the repeating unit of the polystyrene is 10% to 50%.

The polyvinylalcohol/polystyrene copolymer used in the cellulose-based fibers of the present invention may be a random copolymer or a block copolymer, and the random copolymer is preferable for revealing uniform properties during preparation of the fibers.

The total fineness of filaments of the cellulose-based composite fibers of the present invention may be 1000 to 3000 denier. Since the total fineness of the cellulose-based composite fibers is in the range, the cellulose-based composite fibers can be preferably applied to a tire cod and the like.

The cellulose-based composite fibers show superior tensile properties to the prior cellulose-based fibers, and particularly show tenacity of 7 g/d to 10 g/d, and preferably 8 g/d to 9 g/d, elongation of 6% to 15%, and preferably 7% to 13%, and an initial modulus of 200 g/d to 400 g/d.

On the other hand, the cellulose-based fibers of the present invention may be prepared by a method including the steps of a) preparing a spinning dope including cellulose and at least one polymer selected from the group consisting of a polysiloxane, a polyacrylic acid, a polyacrylamide, an m-aramid, and a polyvinylalcohol/polystyrene copolymer, b) preparing multi-filaments by spinning the dope, c) solidifying the filaments, d) washing the solidified filaments, and e) drying the washed filaments.

For one embodiment, the cellulose-based fibers may be prepared by a method including the steps of i) preparing a spinning dope by dissolving the cellulose and the polymer in at least one solvent selected from the group consisting of N-methylmorpholine-N-oxide, N-methylpyrrolidone, dimethylacetamide, and water, ii) preparing multi-filaments by spinning the spinning dope by extrusion through spinning nozzles, and solidifying the same, and iii) washing and drying the prepared multi-filaments.

At this time, the solvent for preparing the dope may be mixed with the raw materials so that the content of the mixture of the raw materials included in the dope is 5 to 35 wt %, or 7 to 18 wt %, in order to prepare a homogeneous dope solution.

Furthermore, the step of preparing the spinning dope may use a suitable solvent according to the polymer, and the step may be carried out by dissolving the cellulose and the polymer in the solvent at the same time, or by dissolving the cellulose and the polymer in each solvent and then mixing the solutions. Particularly, when the m-aramid is used as the polymer, the step may be preferably carried out by including the steps of preparing an m-aramid solution by dissolving the m-aramid in dimethylacetamide, mixing N-methylmorpholine-N-oxide with the m-aramid solution, and adding and dissolving the cellulose in the solution, A solvent mixture including N-methylmorpholine-N-oxide (NMMO) and water may be used when the polysiloxane, the polyacrylic acid, the polyacrylamide, and the polyvinylalcohol/polystyrene copolymer are used as the polymer. At this time, the process may be carried out by swelling the cellulose and the polymer in the solvent mixture including N-methylmorpholine-N-oxide (NMMO) and water in a weight ratio of 90:10 to 50:50, and eliminating water so that the weight ratio of N-methylmorpholine-N-oxide (NMMO) to water is 93:7 to 85:15.

That is, the content of water included in the solvent for preparing the dope may be 7 to 15 wt %. It is possible to prevent an increase of the melting point of the solvent or an excessive increase of the preparing temperature when the content of water included in the solvent is 7 wt % or more, and the water content may be 15 wt % or less in order to secure the minimum solubility and swelling property of the raw materials.

In the step of preparing the spinning dope, the cellulose and the polymer may be used in a form of powders, and the mixture of the raw materials may be used by mixing the powders in a weight ratio of 99.9:0.1 to 80:20. When the m-aramid is used as the polymer, the weight ratio of the cellulose to the m-aramid may be 70:30 to 99.9:0.1.

Particularly, the process of swelling and dissolving the raw materials may be carried out by firstly dispersing the raw materials in the solvent in which the water content is 10 to 50 wt %, and then secondly swelling and dissolving the raw materials at the same time by lowering the water content in the solvent to 7 to 15 wt %.

Subsequently, ii) the multi-filaments are prepared by spinning the spinning dope by extrusion through the spinning nozzles, and solidifying the same.

Furthermore, the method of mixing and swelling the raw materials through a kneader or a storage tank, and dissolving the raw materials by using thin film evaporator may be used as the spinning method of the raw materials while dissolving the same homogeneously, in addition to the method of using an extruder.

The raw materials may be dissolved through the above processes when the water content in the solvent is 7 to 15 wt %, and the raw materials may be dissolved while eliminating the remaining water in a conventional thin film evaporator or a vacuum kneader after swelling the raw materials at a kneader or a tank at first when the water content in the solvent is 20 to 50 wt %.

The solidifying process of the spun multi-filaments is carried out in a solidifying bath, and the solidifying temperature may be 45° C. or less. The solidifying temperature is 45° C. or less to maintain a suitable solidifying speed, because the temperature is not higher than need be. At this time, the solidifying bath may be prepared and used according to a conventional constitution in the art to which the present invention pertains, and thus it is not particularly limited.

Subsequently, iii) the steps of washing and drying the prepared multi-filaments are carried out.

According to the present invention, the washing temperature may be 35° C. or less considering the simplicity of collecting and recycling the solvent after washing, and the drying temperature may be 90 to 200° C. or 100 to 150° C., and tension of 0.1 to 2 g/d, or 0.3 to 1 g/d may be granted to the filaments, in the washing and drying step. The drying step may be carried out with a one-step drying process, and may also be carried out with a multi-step drying process that is divided into a plurality of sections and in which different drying conditions are applied to each section. At this time, a conventional conditions in the art to which the present invention pertains may be used in the washing and drying step, and the present invention is not particularly limited to or by the above conditions.

In addition, the present invention provides a tire cord prepared from the cellulose-based fibers.

One embodiment of a method of preparing the tire cord is as follows. The tire cord may be prepared by preparing a raw cord by twisting the cellulose-based fibers prepared according the above method with a twister, weaving the same with a weaving machine, and dipping the same in a dipping solution. However, the method of preparing the tire cord is not limited to the above method, and the tire cord may be prepared by using a conventional method in the art to which the present invention pertains.

Hereinafter, the present invention is described in further detail through examples. However, the following examples are only for the understanding of the present invention and the present invention is not limited to or by them.

EXAMPLES

Example 1

Composite Fibers of Cellulose and a Polysiloxane

Firstly, cellulose (the content of alpha-cellulose was 96% or more; V-81, Buckeye Co.) sheets were prepared into powders by introducing the same into a pulverizer equipped with a screen filter. A polysiloxane including the repeating unit of the following Chemical Formula 6 was prepared by self-polymerization of aminosilanes in the presence of water ($H_2O$), and it was made into powders. The weight average molecular weight (Mw) of the polysiloxane was 10,000.

[Chemical Formula 6]

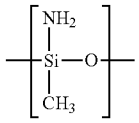

Subsequently, the cellulose powers, the polysiloxane powders, and a NMMO aqueous solution (89° C., water content=13%) were introduced into a twin extruder (diameter of screw (D)=48 mm, L/D=52). The weight ratio of the cellulose to the polysiloxane was 99.9:0.1, the weight ratio of the mixture of the cellulose and the polysiloxane to the NMMO aqueous solution was 100:1000, and the spinning dope was prepared by dissolving the mixture homogeneously with a screw rotating speed of 120 rpm and the dope was spun into a solidifying bath through spinning nozzles (diameter of 0.2 mm, 1000 orifices).

A 10 wt % NMMO aqueous solution was used as a solidifying solution held in a solidifying bath, and the temperature was maintained to be 25° C.

The cellulose-based fibers were prepared by solidifying the fibers in the solidifying bath, soaking and washing the same in the washing bath, and drying the same.

Example 2

Composite Fibers of Cellulose and a Polysiloxane

The cellulose-based fibers were prepared substantially according to the same method as in Example 1, except that the weight ratio of the cellulose to the polysiloxane was 95:5 instead of 99.9:0.1.

Example 3

Composite Fibers of Cellulose and a Polysiloxane

The cellulose-based fibers were prepared substantially according to the same method as in Example 1, except that the weight ratio of the cellulose to the polysiloxane was 90:10 instead of 99.9:0.1.

Example 4

Composite Fibers of Cellulose and a Polysiloxane

The cellulose-based fibers were prepared substantially according to the same method as in Example 1, except that the weight ratio of the cellulose to the polysiloxane was 80:20 instead of 99.9:0.1.

Example 5

Composite Fibers of Cellulose and a Polyacrylic Acid

The cellulose-based fibers were prepared substantially according to the same method as in Example 1, except that a polyacrylic acid (Aldrich Co., USA) was used instead of the polysiloxane. The polyacrylic acid having a viscosity average molecular weight (Mv) of 4,000,000 was used in a form of powder.

Example 6

Composite Fibers of Cellulose and a Polyacrylic Acid

The cellulose-based fibers were prepared substantially according to the same method as in Example 5, except that the weight ratio of the cellulose to the polyacrylic acid was 95:5 instead of 99.9:0.1.

Example 7

Composite Fibers of Cellulose and a Polyacrylic Acid

The cellulose-based fibers were prepared substantially according to the same method as in Example 5, except that the weight ratio of the cellulose to the polyacrylic acid was 90:10 instead of 99.9:0.1.

Example 8

Composite Fibers of Cellulose and a Polyacrylic Acid

The cellulose-based fibers were prepared substantially according to the same method as in Example 5, except that the weight ratio of the cellulose to the polyacrylic acid was 80:20 instead of 99.9:0.1.

Example 9

Composite Fibers of Cellulose and a Polyacrylamide

The cellulose-based fibers were prepared substantially according to the same method as in Example 1, except that a polyacrylamide (Fluka BioChemik Co., USA) was used instead of the polysiloxane. The polyacrylamide having a weight average molecular weight (Mw) of 6,000,000 was used in a form of powder.

Example 10

Composite Fibers of Cellulose and a Polyacrylamide

The cellulose-based fibers were prepared substantially according to the same method as in Example 9, except that the weight ratio of the cellulose to the polyacrylamide was 95:5 instead of 99.9:0.1.

Example 11

Composite Fibers of Cellulose and a Polyacrylamide

The cellulose-based fibers were prepared substantially according to the same method as in Example 9, except that the weight ratio of the cellulose to the polyacrylamide was 90:10 instead of 99.9:0.1.

Example 12

Composite Fibers of Cellulose and a Polyacrylamide

The cellulose-based fibers were prepared substantially according to the same method as in Example 9, except that the weight ratio of the cellulose to the polyacrylamide was 80:20 instead of 99.9:0.1.

Example 13

Composite Fibers of Cellulose and an m-Aramid

Firstly, cellulose (the content of alpha-cellulose was 96% or more; V-81, Buckeye Co.) sheets were prepared into powders by introducing the same into a pulverizer equipped with a screen filter. An m-aramid solution was prepared by dissolving 3 kg of an m-aramid in 7 kg of dimethylacetamide at 100° C. At this time, the m-aramid having an intrinsic viscosity of 1.5 was used.

Subsequently, the m-aramid solution (feeding speed=99 g/h) and liquefied NMMO (89° C., water content=13%, feeding speed=5000 g/h) were introduced into a twin extruder (diameter of screw (D)=48 mm, L/D=52), and then the cellulose powders (feeding speed=561 g/h) were introduced therein. At this time, the weight ratio of the cellulose to the m-aramid was 85:15.

After dissolving the mixture homogeneously with a screw rotating speed of 120 rpm, the dissolved mixture was spun into a solidifying bath through spinning nozzles (diameter of 0.2 mm, 1000 orifices).

A 10 wt % NMMO aqueous solution was used as a solidifying solution held in a solidifying bath, and the temperature was maintained to be 25° C.

The cellulose-based fibers were prepared by solidifying the composite fibers in the solidifying bath, soaking and washing the same in the washing bath, and drying the same.

Example 14

Composite Fibers of Cellulose and an m-Aramid

The cellulose-based fibers were prepared substantially according to the same method as in Example 13, except that the weight ratio of the cellulose to the m-aramid was 99.9:0.1.

Example 15

Composite Fibers of Cellulose and an m-Aramid

The cellulose-based fibers were prepared substantially according to the same method as in Example 13, except that the weight ratio of the cellulose to the m-aramid was 70:30.

Example 16

Composite Fibers of Cellulose and an m-Aramid

The cellulose-based fibers were prepared substantially according to the same method as in Example 13, except that an m-aramid having an intrinsic viscosity of 2.0 was used.

Example 17

Composite Fibers of Cellulose and an m-Aramid

The cellulose-based fibers were prepared substantially according to the same method as in Example 13, except that an m-aramid having an intrinsic viscosity of 0.8 was used.

Example 18

Composite Fibers of Cellulose and a Polyvinylalcohol/Polystyrene Copolymer

Cellulose sheets (V-81, Buckeye Co.) and polyvinylalcohol/polystyrene copolymer chips were mixed in a weight ratio of 99.9:0.1, and introduced into a pulverizer equipped with a 100 mesh filter in order to prepare powders having a diameter of 1700 μl or less. At this time, the polyvinylalcohol/polystyrene copolymer was prepared by copolymerizing vinylacetate monomers and styrene monomers with a mole ratio of 8:2, and saponifying the acetate parts of the copolymer by using a sodium hydroxide solution (NaOH, 40%), and the viscosity average molecular weight of the copolymer was 4,000,000.

The cellulose powders and the polyvinylalcohol/polystyrene copolymer were swelled in a 50 wt % NMMO aqueous solution. At this time, the cellulose content in the NMMO solution was 6.5 wt %.

The swelled cellulose slurry was introduced into a kneader of which internal temperature was maintained to 90° C. and absolute pressure was maintained to 50 mmHg at a speed of 16 kg/hour with a rotary valve type pump, the cellulose was completely dissolved while eliminating the remaining water from the swelled cellulose slurry so as to make the 50 wt % NMMO aqueous solution be an 89 wt % NMMO aqueous solution, and the spinning dope was prepared by dissolving the slurry homogeneously with a screw rotating speed of 120 rpm, and then the dope was spun into a solidifying bath through spinning nozzles (diameter of 0.2 mm, 1000 orifices).

At this time, the cellulose content of the spinning dope which was extruded into the solidifying bath was 11 wt %. It was recognized that the dope was homogeneous in which undissolved cellulose particles or polyvinylalcohol/polystyrene copolymer were not included.

The cellulose dope was extruded by using a nozzle die, of which the total number of nozzles was 1000 and the cross-sectional area of the nozzle was 0.047 $mm^2$, so that the total fineness of the final filament fibers was 1650 denier.

A 10 wt % NMMO aqueous solution was used as a solidifying solution held in a solidifying bath, and the temperature was maintained to be 25° C.

The cellulose-based fibers were prepared by solidifying the composite fibers in the solidifying bath, soaking and washing the same in the washing bath, and drying the same.

Example 19

Composite Fibers of Cellulose and a Polyvinylalcohol/Polystyrene Copolymer

The cellulose-based fibers were prepared substantially according to the same method as in Example 18, except that the weight ratio of the cellulose to the polyvinylalcohol/polystyrene copolymer was 95:5.

Example 20

Composite Fibers of Cellulose and a Polyvinylalcohol/Polystyrene Copolymer

The cellulose-based fibers were prepared substantially according to the same method as in Example 18, except that the weight ratio of the cellulose to the polyvinylalcohol/polystyrene copolymer was 90:10.

Example 21

Composite Fibers of Cellulose and a Polyvinylalcohol/Polystyrene Copolymer

The cellulose-based fibers were prepared substantially according to the same method as in Example 18, except that the weight ratio of the cellulose to the polyvinylalcohol/polystyrene copolymer was 80:20.

Comparative Example 1

Fibers Prepared by Using Cellulose Only

The cellulose-based fibers were prepared substantially according to the same method as in Example 1, except that the cellulose powders and the NMMO aqueous solution were mixed in a weight ratio of 100:1000 without adding the polysiloxane while preparing the dope.

Comparative Example 2

Composite Fibers Having Different Polymer Content

The cellulose-based fibers were prepared substantially according to the same method as in Example 13, except that the weight ratio of the cellulose to the m-aramid was 55:45.

In addition, the intrinsic viscosity of the m-aramid was measured according to the following method, and each m-aramid was used in Examples 13-17 and Comparative Example 2 according to the measured intrinsic viscosity.

Intrinsic Viscosity (I.V)

An m-aramid specimen that was washed with boiling distilled water was dried at 110° C. for 5 hours and 0.125 g of the specimen was chosen and dissolved in 25 mL of 97% sulfuric acid solution for 4 hours. And then, the I.V was measured according to the following Mathematical Formula 1 by using Canon-Fenske viscometer No. 200.

$$I.V=[\ln(t/t_0)/0.5] \quad \text{[Mathematical Formula 1]}$$

wherein t is a running time of the specimen solution, and $t_0$ is a running time of the sulfuric acid solution.

Furthermore, the cellulose-based composite fibers prepared in Examples 1 to 21 and Comparative Examples 1 to 2 were conditioned by storing the same in the conditions of 25° C., 65% RH for 24 hours, the properties of the cellulose-based fibers were measured according to the following method, and the results are listed in the following Table 1.

Tenacity, Elongation, and Initial Modulus

Each specimen of the cellulose-based composite fibers was dried at 110° C. for 2 hours so as to be below the official regain, and then the tenacity, the elongation, and the initial modulus were measured by a slow straining type of tensile tester of INSTRON Co. according to the KSK 0412 standard, wherein 8 twists per 10 cm (80 TPM) were given to the specimen, the length of the specimen was 250 mm, and the extension speed was 300 mm/min.

TABLE 1

| Specifications | Tenacity [g/d] | Initial Modulus [g/d] | Elongation [%] | Commercial Value High ◎, Middle ○, Low Δ |
|---|---|---|---|---|
| Example 1 | 6.9 | 240 | 6.5 | ◎ |
| Example 2 | 7.3 | 245 | 7.2 | ◎ |
| Example 3 | 7.5 | 250 | 7.7 | ◎ |
| Example 4 | 7.1 | 236 | 8.9 | ◎ |
| Example 5 | 7.1 | 230 | 6.8 | ◎ |
| Example 6 | 7.3 | 236 | 7.5 | ◎ |
| Example 7 | 7.4 | 240 | 9.3 | ◎ |
| Example 8 | 6.9 | 234 | 11.4 | ◎ |
| Example 9 | 6.8 | 230 | 6.9 | ◎ |
| Example 10 | 7.3 | 243 | 7.5 | ◎ |
| Example 11 | 7.2 | 250 | 9.8 | ◎ |
| Example 12 | 7.1 | 230 | 11.9 | ◎ |
| Example 13 | 7.8 | 250 | 13 | ◎ |
| Example 14 | 7.2 | 230 | 7.5 | ◎ |
| Example 15 | 6.9 | 200 | 8.6 | ◎ |
| Example 16 | 7.6 | 230 | 11 | ◎ |
| Example 17 | 7.5 | 210 | 12 | ◎ |
| Example 18 | 7.0 | 230 | 7.6 | ◎ |
| Example 19 | 7.5 | 249 | 8.9 | ◎ |
| Example 20 | 7.2 | 248 | 11.5 | ◎ |
| Example 21 | 7.1 | 238 | 12.4 | ◎ |
| Comparative Example 1 | 6.5 | 180 | 5.7 | ○ |
| Comparative Example 2 | 6.2 | 170 | 5.3 | Δ |

As shown in Table 1, it is recognized that the composite fibers of the present invention prepared according to Examples 1 to 21 are superior in various properties, such as tenacity, initial modulus, and elongation, and can be applied to a tire cord.

In comparison, the fibers prepared according to Comparative Examples 1 and 2 show low properties, particularly low elongation, and there is a limitation to be used for an industrial fiber such as a tire cord.

As shown above, the cellulose-based fibers according to the present invention can secure superior tensile properties, i.e., superior elongation and tenacity to the prior cellulose fibers by blending at least one polymer having a functional group that is capable of a hydrogen bond with a hydroxyl group of a cellulose molecule.

What is claimed is:

1. Cellulose-based fibers having a tenacity of 7 g/d to 10 g/d, an elongation of 6% to 15%, and an initial modulus of 200 g/d to 400 g/d, said fibers including cellulose and an m-aramid, wherein the content of the m-aramid is 10 to 20 wt % based on the total mass of the fibers.

2. The cellulose-based fibers according to claim 1, wherein the m-aramid includes a repeating unit represented by the following Chemical Formula 4:

[Chemical Formula 4]

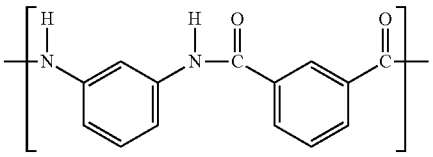

3. The cellulose-based fibers according to claim 1, wherein the intrinsic viscosity of the m-aramid is 0.8 to 2.0.

4. The cellulose-based fibers according to claim 1, having a tenacity of 8 g/d to 9 g/d, an elongation of 7% to 13%, and an initial modulus of 200 g/d to 400 g/d.

5. A tire cord including cellulose-based fibers, said cellulose-based fibers having a tenacity of 7 g/d to 10 g/d, an elongation of 6% to 15%, and an initial modulus of 200 g/d to 400 g/d, wherein the fibers include a cellulose and an m-aramid, and wherein the content of the m-aramid is 10 to 20 wt % based on the total mass of the fibers.

6. The tire cord according to claim 5, wherein the m-aramid includes a repeating unit represented by the following Chemical Formula 4:

[Chemical Formula 4]

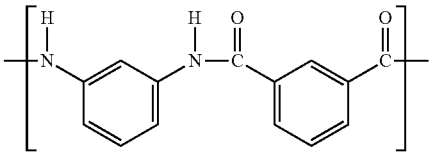

7. The tire cord according to claim 5, wherein the intrinsic viscosity of the m-aramid is 0.8 to 2.0.

8. The tire cord according to claim 5, wherein the cellulose-based fibers have a tenacity of 8 g/d to 9 g/d, an elongation of 7% to 13%, and an initial modulus of 200 g/d to 400 g/d.

9. A method of preparing cellulose-based fibers, said cellulose-based fibers having a tenacity of 7 g/d to 10 g/d, an elongation of 6% to 15%, and an initial modulus of 200 g/d to 400 g/d, wherein the fibers include a cellulose and an m-aramid, and wherein the content of the m-aramid is 10 to 20 wt % based on the total mass of the fibers, the method including the steps of:

preparing a spinning dope including cellulose and an m-aramid, wherein the cellulose and the m-aramid is mixed in a weight ratio of 90:10 to 80:20;

preparing multi-filaments by spinning the dope;

solidifying the filaments;

washing the solidified filaments; and drying the washed filaments to give the cellulose-based fibers.

10. The method according to claim 9, wherein the m-aramid includes a repeating unit represented by the following Chemical Formula 4:

[Chemical Formula 4]

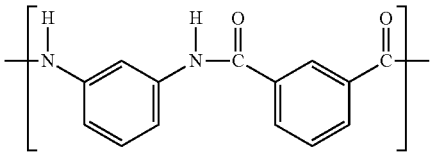

11. The method according to claim 9, wherein the intrinsic viscosity of the m-aramid is 0.8 to 2.0.

12. The method according to claim 9, wherein the cellulose-based fibers have a tenacity of 8 g/d to 9 g/d, an elongation of 7% to 13%, and an initial modulus of 200 g/d to 400 g/d.

* * * * *